US009415410B2

(12) United States Patent
Fontaine

(10) Patent No.: US 9,415,410 B2
(45) Date of Patent: Aug. 16, 2016

(54) CLOG RETARDING FILTERING APPARATUS FOR INLET FLUID INTO A PRESSURE CHAMBER OF A SPRAYER

(71) Applicant: CHAPIN MANUFACTURING, INC., Batavia, NY (US)

(72) Inventor: James R. Fontaine, Marilla, NY (US)

(73) Assignee: CHAPIN MANUFACTURING, INC., Batavia, NY (US)

( * ) Notice: Subject to any disclaimer, the term of this patent is extended or adjusted under 35 U.S.C. 154(b) by 131 days.

(21) Appl. No.: 14/213,385

(22) Filed: Mar. 14, 2014

(65) Prior Publication Data

US 2014/0261755 A1 Sep. 18, 2014

Related U.S. Application Data

(60) Provisional application No. 61/799,737, filed on Mar. 15, 2013.

(51) Int. Cl.
*B05B 15/02* (2006.01)
*B05B 9/08* (2006.01)

(52) U.S. Cl.
CPC ..... *B05B 15/0208* (2013.01); *B05B 9/0877* (2013.01); *B05B 9/0888* (2013.01); *B05B 15/02* (2013.01); *Y10T 137/4238* (2015.04)

(58) Field of Classification Search
CPC B05B 15/0208; B05B 9/0877; B05B 9/0888; B05B 15/02; B05B 15/025; B05B 15/0258; Y10T 137/4238
USPC ..... 137/237, 240
See application file for complete search history.

(56) References Cited

U.S. PATENT DOCUMENTS

| | | | | |
|---|---|---|---|---|
| 1,081,648 | A | 12/1913 | Adams | |
| 3,513,978 | A | 5/1970 | Newsteder | |
| 3,788,484 | A | 1/1974 | Godin | |
| 4,376,053 | A | 3/1983 | Bullock et al. | |
| 4,651,903 | A | 3/1987 | Pagliai | |
| 4,688,643 | A | 8/1987 | Carter et al. | |
| 4,702,416 | A | 10/1987 | Pagliai et al. | |
| 4,702,419 | A | 10/1987 | Luchsinger | |
| 4,753,723 | A | 6/1988 | Willinger | |
| 4,768,714 | A | 9/1988 | Luchsinger | |
| 4,798,333 | A | 1/1989 | Luchsinger | |
| 5,240,151 | A | 8/1993 | Worm | |
| 5,335,853 | A | 8/1994 | Wirz | |
| 5,603,361 | A | 2/1997 | Cuisinier | |
| 5,636,791 | A | 6/1997 | Leer | |
| 5,671,884 | A | 9/1997 | Restive | |
| 5,961,048 | A | 10/1999 | Prieschl et al. | |
| 6,412,707 | B1 | 7/2002 | Wirz | |
| 6,440,303 | B2 | 8/2002 | Spriegel | |
| 7,028,925 | B2 | 4/2006 | Guest et al. | |
| 7,100,540 | B2 | 9/2006 | Vaughan | |
| 7,222,389 | B2 | 5/2007 | Morgan et al. | |
| 7,789,329 | B2 | 9/2010 | Klein | |
| 8,622,323 | B2 | 1/2014 | Klein | |
| 2014/0326326 | A1 * | 11/2014 | Antoun | B08B 3/14 137/15.01 |

FOREIGN PATENT DOCUMENTS

| | | |
|---|---|---|
| EP | 0 445 989 | 11/1991 |

* cited by examiner

*Primary Examiner* — Kevin Lee
(74) *Attorney, Agent, or Firm* — Kenneth J. Lukacher Law Group

(57) ABSTRACT

To assist the filtering from a tank into the inlet port of the pressure chamber of a sprayer, an additional pumping structure is attached to the pumping mechanism of the sprayer. A hose extends into the tank of the sprayer and draws fluid from the tank into the additional pumping structure. Fluid is pumped from the additional pumping structure via the hose to provide a jet of fluid upon a filter over the inlet port. The jet of fluid flushes the filter and retards the accumulation of debris thereon, thereby retarding the clogging of the filter.

13 Claims, 5 Drawing Sheets

CLOG RETARDING FILTERING APPARATUS FOR INLET FLUID INTO A PRESSURE CHAMBER OF A SPRAYER

Priority is claimed to U.S. Provisional Application No. 61/799,737, filed Mar. 15, 2013, which is herein incorporated by reference.

DESCRIPTION

This invention relates to an apparatus for retardation of clogging in a filtering apparatus for inlet fluid into the pressure chamber of a sprayer, and more particularly to an improvement over the filtering apparatus illustrated in Klein, U.S. Pat. Nos. 7,789,329 (the Klein patent) and U.S. Pat. No. 8,622,323, which are incorporated herein by reference.

As shown in the Klein patent, the removable filter may be provided adjacent to the inlet port of the pressure chamber of the sprayer. The filter is manually removable and replaceable via the opening of the sprayer tank. The removal and replacement of the filter has engendered some difficulty, and from time to time, the filter has not been timely removed and some clogging of the filter has occurred. It has become desirable not to rely on the operator to remove the filter when necessary and to provide a separate means for preventing clogging of the filter. Merely providing agitation of the liquid at the bottom of the tank has found to be insufficient to avoid clogging of the filter. For apparatus' for agitating the liquid at the bottom of the tank, see Luchsinger U.S. Pat. No. 4,768,714, issued Sep. 6, 1988, and Luchsinger U.S. Pat. No. 4,798,333, issued Jan. 17, 1989.

Accordingly, it is the principal feature of the present invention to provide an improved filtering apparatus for inlet fluid into the pressure chamber of a sprayer which facilitates the retardation of clogging of a filter which may be removably disposed over the inlet to the pressure chamber.

It is a more specific feature of this invention to provide clogging resistance for a filter, such as shown in the Klein patent, and to lengthen the time between removal and replacement of the filter and thereby reduce the need for operator assistance for maintaining the filter clear of debris.

Briefly described, the clogging retardation apparatus provided by the present invention includes a structure defining an auxiliary pumping chamber associated with the pump of the sprayer which pressurizes the liquid to be sprayed. Liquid enters the pressure chamber, via an inlet port from the tank of the sprayer. The auxiliary pumping chamber is connected via a hose in a position facing the filter which is removably disposed over the inlet port of the pressure chamber. This hose provides a jet of fluid directed against the filter for flushing the filter, thereby retarding the accumulation of sediment and other clogging materials at the filter. In addition, the hose provides a conduit for fluid from the tank into the auxiliary chamber so that it can be pumped and thrust outwardly through the hose to flush the filter and to prevent accumulation of material which may clog the filter.

The present invention also describes a method for retarding accumulation of clogging material on a filter of a sprayer pump having the steps of: providing a sprayer pump having a pressure chamber with an inlet for receiving fluid from a tank (or container) into which the pressure chamber is received, providing a filter in the tank adjacent such inlet, and providing an auxiliary pump having an auxiliary pressure chamber for directing fluid from the tank along a path from said second pressure chamber against the filter to flush such filter. The sprayer pump and the auxiliary pump are preferably coupled to a common actuator mechanism for simultaneous operation.

The foregoing and other objects, features and advantages of the invention will be more apparent from reading the following description in connection with the accompanying drawings in which.

Figure 1:
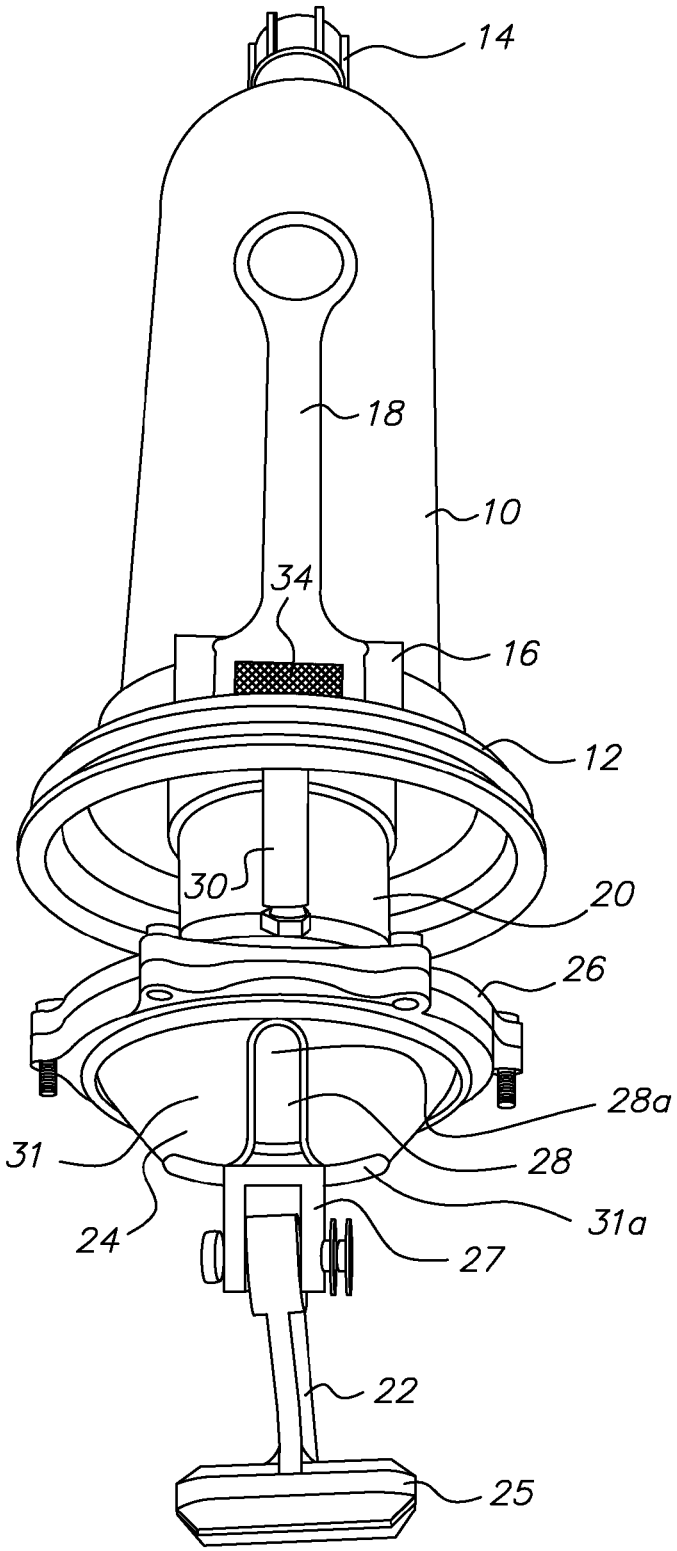
FIG. 1 is a view looking upward from the bottom of the auxiliary pumping mechanism, the auxiliary pumping mechanism is connected to the bottom of the pressure chamber with the removable filter shown in place over the inlet to the pressure chamber from the tank, the tank not being shown but apparent from the drawings and description of the Klein patent.

Referring to FIGS. 1-4, a pressure chamber 10 is connected to the surrounding tank of the sprayer by a flange 12 extending from the bottom thereof. The general design of the pressure chamber 10 including its pressure relief valve 14 (FIG. 1) at the top thereof and the connection to the tank will be apparent from the aforementioned Klein patent (see tank and pressure chamber referenced as elements 10 and 16, respectively, in the incorporated Klein patent). The pressure chamber 10 has an inlet port assembly 16 having an inlet port 17 (FIG. 2) to which is connected a removable filter 18 as described in the Klein patent (see inlet port and filter referenced as 34 and 30, respectively, in the incorporated Klein patent). Entering into the tank is the pumping apparatus 20 of the sprayer which includes the pump piston, operated via a crank mechanism 22 (see pumping mechanism referenced as 22 in the incorporated Klein patent) with the improvement of the present invention having an auxiliary (or additional) pumping structure 24.

The crank mechanism 22 has a crank arm 25 operative by cranking a lever manually, as shown for example in abovementioned Luchsinger patents or the Klein patent. The mechanism 22 has another arm 27 which is connected to reciprocate the diaphragm 28*a* of the diaphragm pump 28 in the structure 24.

The arm 27 is also coupled mechanically to the pump piston in the main pumping apparatus 20. Crank arm 25 may be pivotally mounted to arm 27, as shown in FIG. 1. The auxiliary pumping structure 24 is connected via clamping rings 26 to the pumping apparatus 20 of the sprayer. The auxiliary pumping structure 24, as noted above, includes an auxiliary pressure chamber 29 (FIG. 5) and a diaphragm pump 28, the outside of which is shown in FIG. 1. This diaphragm pump 28 is driven together with the piston in the pumping apparatus 20 by means of the crank mechanism 22, thereby providing a common actuator mechanism.

Figure 5:
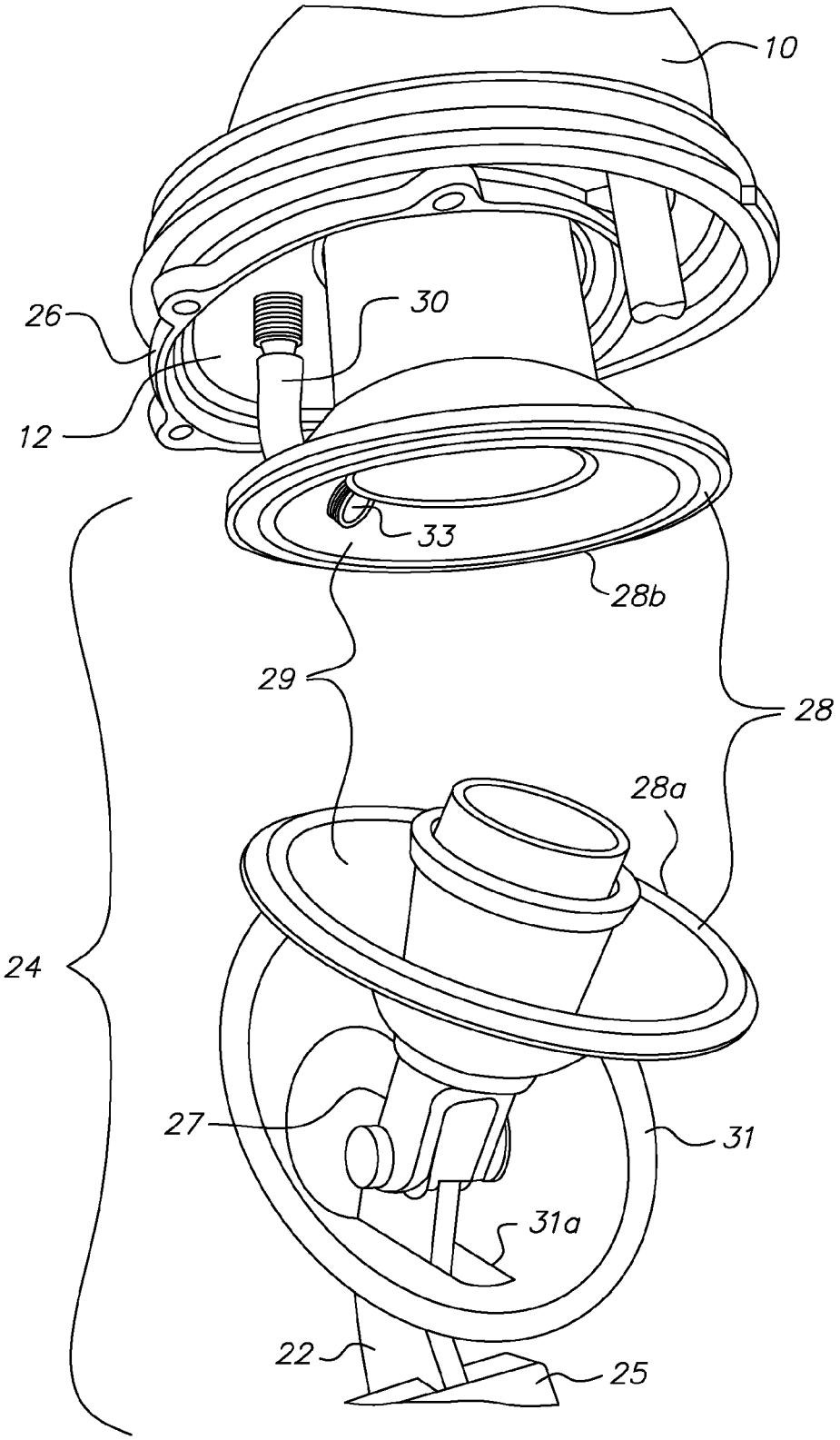
FIG. 5 is a partial exploded view of lower part of the pumping structure of FIG. 1.

Referring to FIG. 5, the lower part of pumping apparatus 20 is shown disassembled at clamping rings 26 thereby enabling a better view of the auxiliary pumping structure 24 contained therein having diaphragm pump 28. In the preferred embodiment, diaphragm pump 28 has a rigid outwardly flared upper section 28*b* extending from pump chamber 10, and a lower dome-shaped diaphragm 28*a* which mates along the edges of upper section 28*b* to form auxiliary pressure chamber 29 there between. Diaphragm 28*a* may be made, for example, of plastic, rubber or other resilient material, so that it can move forward and back (e.g., between flexed and unflexed positions) with respect to upper section 28*b* when reciprocated by arm 27, which is connected along the bottom of diaphragm 28*a*. Further information as to the design of the diaphragm pump in the auxiliary or additional pumping structure reference is made to the above-mentioned Luchsinger patents.

One lower end 33 of a hose 30 is located in an opening in section 28*b* to extend into auxiliary pumping chamber 29, while the upper end 32 of the hose is disposed in an opening in flange 12 (see FIG. 2) residing in a tank into which the main pressure chamber 10 is located. Fluid can pass through hose 30 between such tank and auxiliary pumping chamber 29 during diaphragm pump 28 operation. A frustoconical cover 31 may be provided over diaphragm 28*a* when diaphragm 28*a* and upper diaphragm section 28*b* are clamped together by clamping rings 26. Cover 31 has an opening 31*a* for arm 27 to extend there through.

The piston of the pump apparatus 20 draws fluid from the tank via the inlet port assembly/structure 16, i.e., via inlet port 17, pressurizing the pressure chamber 10 which supplies pressurized fluid out of the pressure chamber for spraying, as described in detail in the Klein patent. The auxiliary pressure chamber 29 is pressurized by the diaphragm 28*a* of diaphragm pump 28. The diaphragm 28*a* of diaphragm pump 28 sucks liquid from the tank into the auxiliary chamber 29, via the hose 30 (e.g., in a direction or path from hose end 32 to end 33), and pumps the liquid out of the auxiliary pressure chamber 29 through the hose 30 (e.g., in a direction or path from hose end 33 to end 32) in a stream or jet of fluid directed upon the filter 18 (i.e., filter screen 34).

Figure 2:
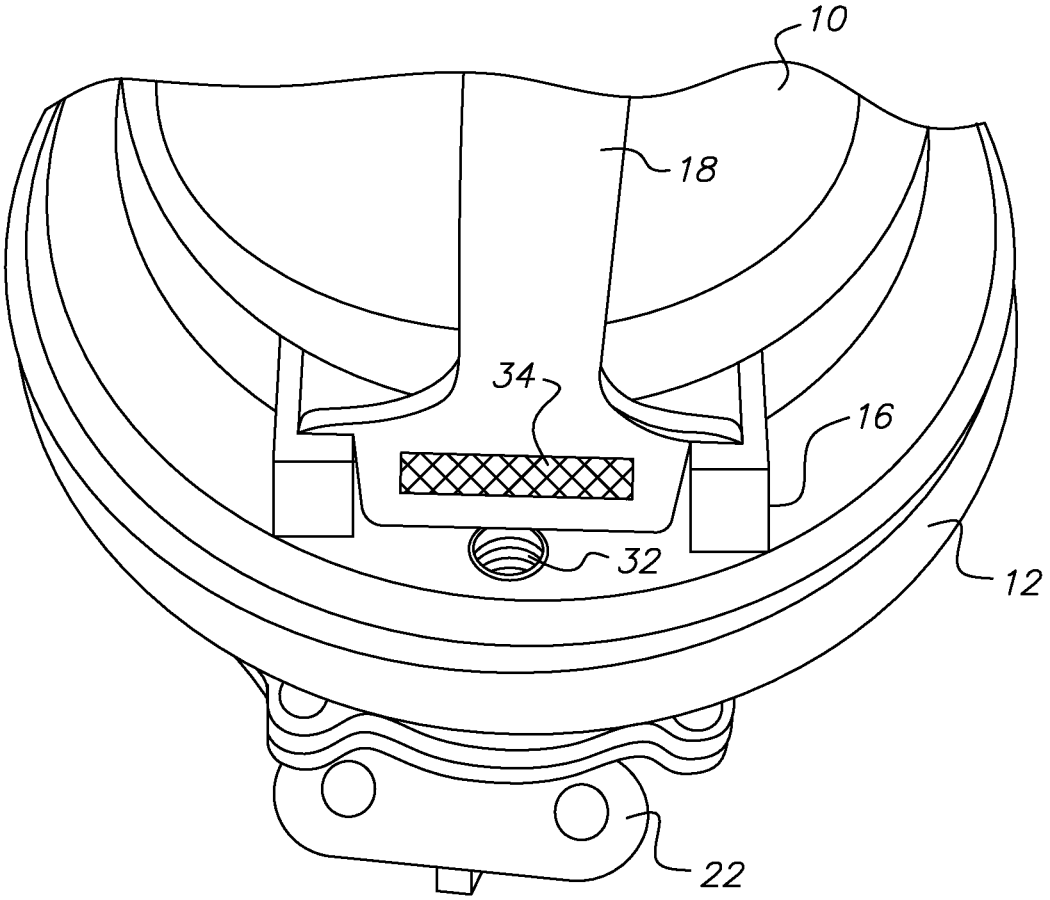
FIG. 2 is a view looking downwardly to end of the flushing hose from the auxiliary pressure chamber showing the filter in place.
Figure 3:
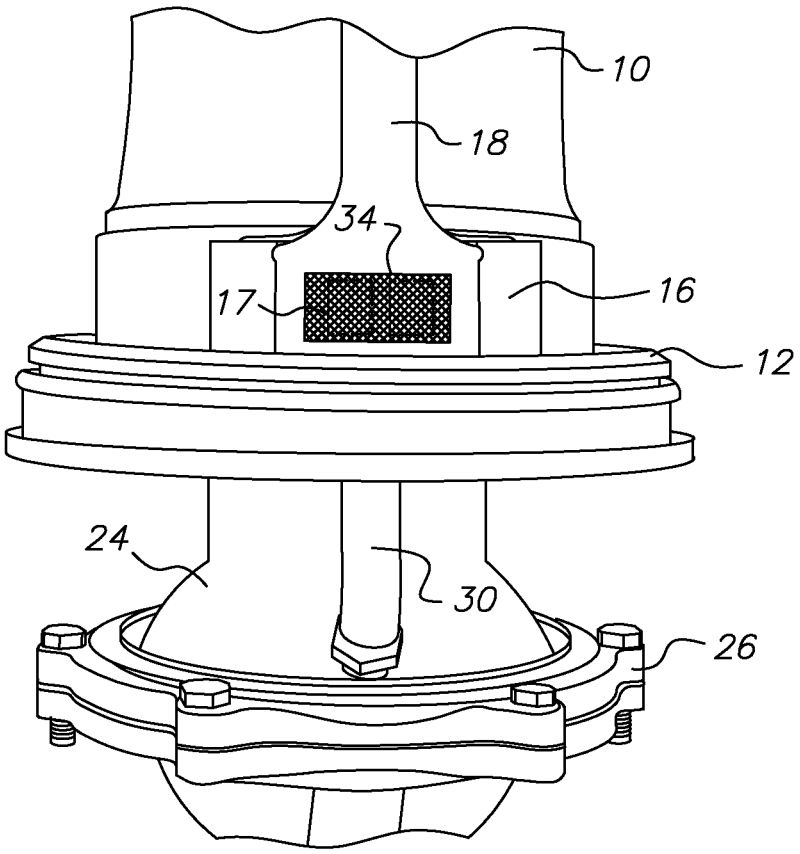
FIG. 3 is a view taken from the front showing the hose emanating from the chamber and extending into a flange at the bottom of the pressure chamber.
Figure 4:
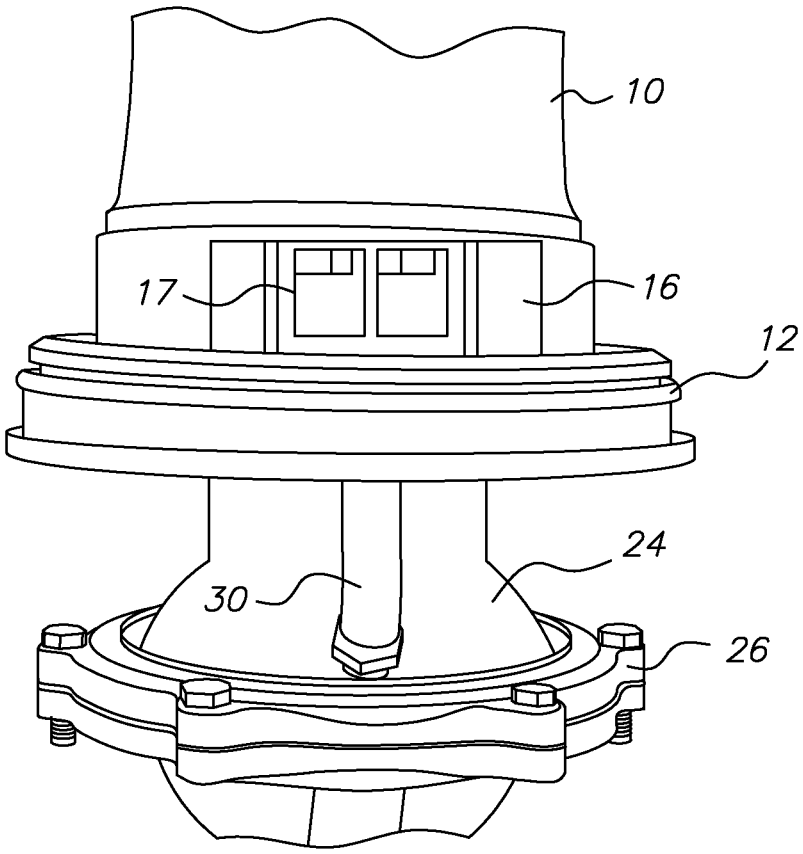
FIG. 4 is a view similar to FIG. 3, but with the filter removed.

The auxiliary pumping chamber 29 is connected via the hose 30 through the flange 12 to an outlet adjacent to the filter 18 of the filtering apparatus which is shown over the inlet port 17 to the pressure chamber 10. The filter 18 presents a screen 34 over the openings in the inlet port 17. FIG. 2 shows the exit end 32 of the hose 30 extending through the flange 12 and adjacent to and in flushing relationship with the filter screen 34 of the removable filter 18. The inlet structure 16 is shown with the filter 18 removed in FIG. 4.

The filter 16 and particularly the screen 34 thereof is subject to clogging by sediment and other components of the liquid in the tank as the liquid flows inwards and outwards of the inlet port. The provision of the hose 30 is to enable a jet directed towards the screen 34 of the filter 16, or over the screen, to direct the jet to flush the filter 16 and to remove the material which may be clogging the filter screen 34, thereby lengthening the time required for the filter 16 needing to be removed and replaced, and provides an operational advantage by reducing the need for supervision of the operator in so far as attendance to the removal and replacement of the filter 16.

Although the pumping structure 20 is described as being that also shown in the Klein patent, the present invention may be utilized in other typical backpack sprayers having a pumping structure to pressurize fluid in a backpack sprayer tank.

One benefit of the present invention is with each manual pump of the tank, via crank arm 25, to pressurize fluid therein, fluid also is simultaneously being directed against filter screen 34, thus providing dual actions with each forward manual pump stroke.

It will be appreciated that the hose provides for flow of fluid into the auxiliary pressure chamber for pressurization by the diaphragm pump as well as for the delivery of the jet of fluid against or over the filter for flushing the filter thereby retarding the formation of clogging sediment or other material.

Variations and modifications in the herein described apparatus, method, and system will undoubtedly suggest themselves to those skilled in the art. Accordingly, the foregoing should be considered as illustrative and not in a limiting sense.

What is claimed is:

1. In a sprayer comprising a first pressure chamber with an inlet port and a filter disposed over the inlet port, an improvement having an apparatus for retarding accumulation of clogging material on the filter comprising:

a hose providing an outlet adjacent to said filter which directs a stream of fluid in a jet upon or over a surface of the filter thereby flushing the filter; and an auxiliary or additional pressure chamber connected to a pump mechanism coupled to the first pressure chamber, said hose being connected at one end to the auxiliary or additional pressure chamber and at the other end to an outlet adjacent to the filter.

2. The sprayer according to claim 1 wherein said sprayer further comprises a tank, and said fluid is directed to said filter simultaneously with operation of the pump mechanism for pressurizing fluid in the tank of the sprayer.

3. The sprayer according to claim 1 further comprising an auxiliary pumping structure having at least said auxiliary or additional pressure chamber.

4. The sprayer according to claim 3 further comprising a diaphragm pump in said auxiliary pumping structure.

5. The sprayer according to claim 4 wherein said first pressure chamber is a main pressure chamber of the sprayer, a main pump is provided in said main pressure chamber, and said diaphragm pump and said main pump being coupled for operation together such that when said main pump is operated, said diaphragm pump is also operated to flush said filter.

6. The sprayer according to claim 5 further comprising a crank pump actuating mechanism connected in operating relationship with both said main pump and said diaphragm pump.

7. The sprayer according to claim 1 wherein:

said sprayer has a tank containing fluid to be sprayed, said first pressure chamber being disposed on a flange with said inlet port, said auxiliary or additional pressure chamber and said first pressure chamber being disposed on opposite sides of said flange; and an opening through said flange in which said hose is disposed in proximity to the inlet port so that said filter over the inlet port is in a path of said fluid pumped through said hose by an auxiliary pumping structure having at least said auxiliary or additional pressure chamber.

8. A method for retarding accumulation of clogging material on a filter of a sprayer pump comprising:

providing a first pump having a first pressure chamber with an inlet for receiving fluid from a container into which said first pressure chamber is received;

providing a filter in said container adjacent said inlet; and providing a second pump having a second pressure chamber for directing fluid from said container along a path from said second pressure chamber against said filter to flush said filter.

9. The method according to claim 8 further comprising the step of operating said first pump and said second pump simultaneously.

10. A system for retarding accumulation of clogging material on a filter of a sprayer pump comprising:

a first pump having a first pressure chamber with an inlet for receiving fluid from a container of fluid into which said first pressure chamber is receivable;

a filter in said container adjacent said inlet; and a second pump having a second pressure chamber for directing fluid from said container along a path from said second pressure chamber against said filter to flush said filter.

11. The system according to claim 10 further comprising means for operating said first pump and said second pump simultaneously.

12. The system according to claim 10 wherein said second pump is a diaphragm pump.

13. The system according to claim 10 wherein said second pump is disposed below said first pump.

* * * * *